US007104816B1

(12) United States Patent
Wang

(10) Patent No.: US 7,104,816 B1
(45) Date of Patent: Sep. 12, 2006

(54) EXTERNAL CASING FOR A DATA STORAGE DEVICE

(75) Inventor: Chia-Jen Wang, Taipei Hsien (TW)

(73) Assignee: Datastor Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 11/246,431

(22) Filed: Oct. 6, 2005

(30) Foreign Application Priority Data

May 5, 2005 (TW) ..... 94207205

(51) Int. Cl.
*H01R 13/44* (2006.01)

(52) U.S. Cl. ..... 439/136; 439/501

(58) Field of Classification Search ..... 439/136, 439/521, 519, 131, 501
See application file for complete search history.

(56) References Cited

U.S. PATENT DOCUMENTS 6,705,890 B1 * 3/2004 Kitou et al. ..... 439/528
6,705,891 B1 * 3/2004 Lin ..... 439/528
6,722,917 B1 * 4/2004 Huang ..... 439/501
6,960,727 B1 * 11/2005 Hering ..... 174/135

* cited by examiner

*Primary Examiner*—Tho D. Ta
*Assistant Examiner*—Vanessa Girardi
(74) *Attorney, Agent, or Firm*—Ladas & Parry LLP

(57) ABSTRACT

An external casing includes a housing, an interface module, an external electrical connector, a cover component, and a releasable fastening unit. The housing is adapted for receiving a data storage device therein, and is formed with an opening. The interface module is disposed in the housing, and is adapted to connect electrically with the data storage device disposed in the housing. The external electrical connector is connected electrically to the interface module, and is disposed in the housing. The cover component includes a fixing portion that is secured to the housing, a covering portion that extends from the fixing portion, and an engaging portion that extends from the covering portion. The releasable fastening unit is provided on the engaging portion of the cover component and the housing to retain releasably the engaging portion on the housing such that the covering portion covers the opening in the housing.

20 Claims, 3 Drawing Sheets

EXTERNAL CASING FOR A DATA STORAGE DEVICE

CROSS-REFERENCE TO RELATED APPLICATION

This application claims priority of Taiwanese Application No. 094207205, filed on May 5, 2005.

BACKGROUND OF THE INVENTION

1. Field of the Invention

The invention relates to an external casing for a data storage device, more particularly to an external casing that has a cover component for protecting an external electrical connector from dust when the external electrical connector is not in use.

2. Description of the Related Art

A conventional external casing for a portable data storage device, such as a hard disk, usually includes a housing and an electrical connector disposed in the housing and adapted to connect to an internal data storage medium. The electrical connector is constantly exposed from the housing so as to facilitate connection to a computer. However, dust can easily accumulate on the exposed electrical connector. In addition, when carrying the external casing, the exposed electrical connector is vulnerable to damages from scratches and bumping with other objects.

SUMMARY OF THE INVENTION

Therefore, the object of the present invention is to provide an external casing that is adapted to receive a data storage device, and that is capable of protecting an electrical connector thereof from direct and constant exposure to the environment.

According to the present invention, there is provided an external casing that includes a housing, an interface module, an external electrical connector, a cover component, and a releasable fastening unit. The housing has opposite first and second housing walls, confines a compartment that is adapted for receiving a data storage device therein, and is formed with an opening for access into the compartment. The interface module is disposed in the compartment, and is adapted to connect electrically with the data storage device disposed in the compartment. The external electrical connector is connected electrically to the interface module, and is disposed in the compartment in the vicinity of the opening. The cover component includes a fixing portion that is secured to the first housing wall, a covering portion that extends from the fixing portion, and an engaging portion that extends from the covering portion. The releasable fastening unit is provided on the engaging portion of the cover component and the second housing wall to retain releasably the engaging portion on the housing such that the covering portion covers the opening in the housing.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
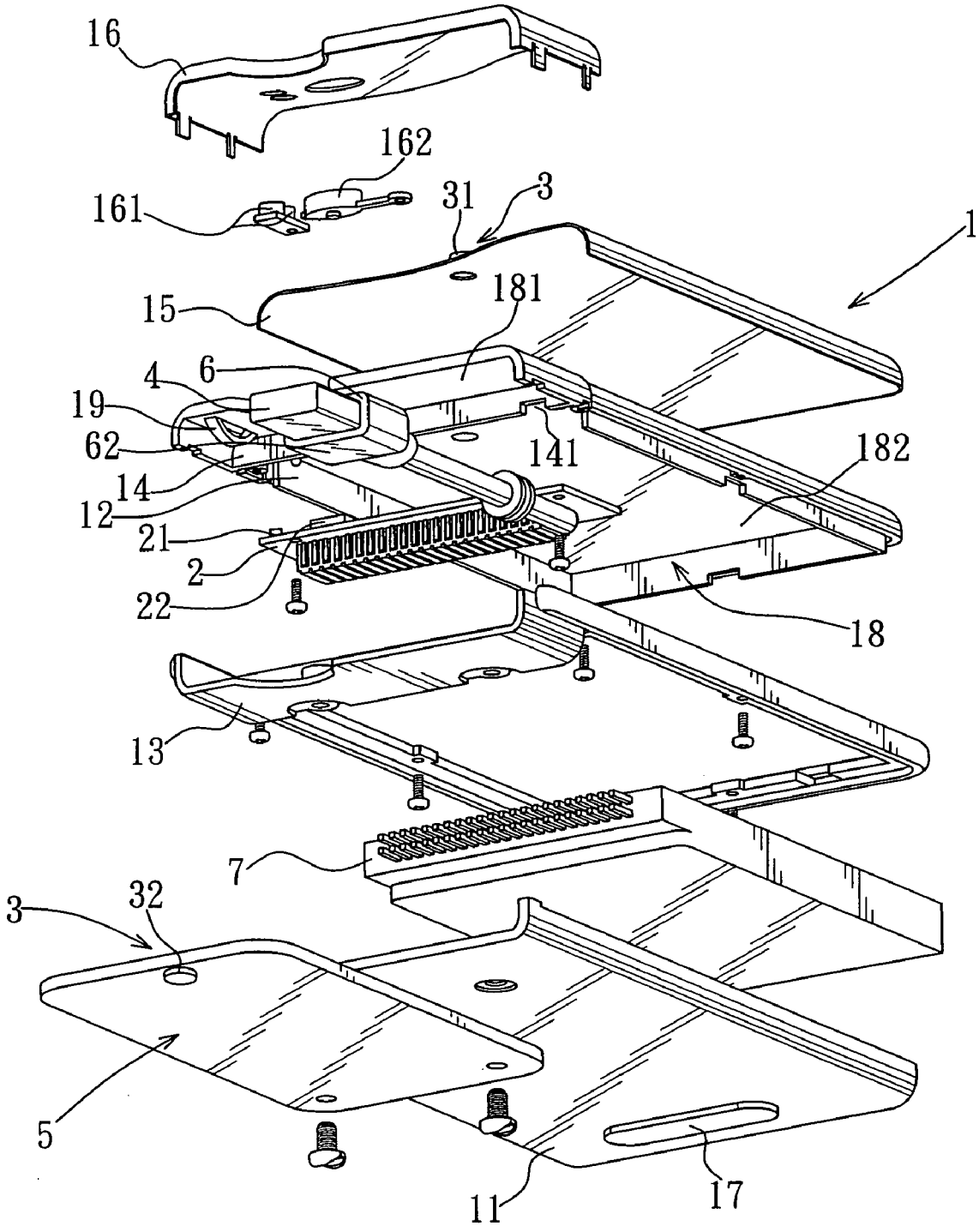
FIG. 1 is an exploded perspective view of the preferred embodiment of an external casing for a data storage device according to the present invention.

As shown in FIG. 1, the preferred embodiment of an external casing according to the present invention includes a housing 1, an interface module 2, an external electrical connector 4, a cover component 5, a releasable fastening unit 3, and a transmission cable 6.

The housing 1 includes opposite first and second housing walls 11, 12, a looped metal frame 13, a leather skin layer 15, a cover plate 16, and an anti-slip pad 17. The first and second housing walls 11, 12 cooperate to confine a compartment 18, and an opening 10 (refer to FIG. 3) for access into the compartment 18. The compartment 18 is adapted for receiving a data storage device 7 therein. The opening 10 has a width that is approximately equal to the widths of the first and second housing walls 11, 12. The looped metal frame 13 interconnects the first and second housing walls 11, 12, and provides shock absorption functionality for the external casing. The leather skin layer 15 is disposed on the second housing wall 12, while the cover plate 16 is superimposed on a portion of the leather skin layer 15 in the vicinity of the opening 10. The cover plate 16 is provided with a user-operable button 162 that extends through the leather skin layer 15 and the second housing wall 12 into the compartment 18. The anti-slip pad 17 is provided on the first housing wall 11.

In this embodiment, the first housing wall 11 and the cover plate 16 are made from metal materials, while the second housing wall 12 is made from a plastic material.

The interface module 2 is disposed in the compartment 18, and is adapted to connect electrically with the data storage device 7 that is disposed in the compartment 18. In this embodiment, the interface module 2 includes a switch 22 that is coupled to and actuated through the user-operable button 162 for data access control. The interface module 2 further includes two status indicators 21 for providing visual indication of data access state of the data storage device 7 that is visible through the second housing wall 12 and the leather skin layer 15. The cover plate 16 is provided with two light guides 161 for the status indicators 21. Each of the status indicators 21 includes a light-emitting diode (LED) in this embodiment, but is not limited thereto.

The external electrical connector 4 is connected electrically to the interface module 2, and is disposed in the compartment 18 in the vicinity of the opening 10. In this embodiment, the external electrical connector 4 is a Universal Serial Bus (USB) connector, but is not limited thereto in other embodiments of the present invention.

Figure 3:
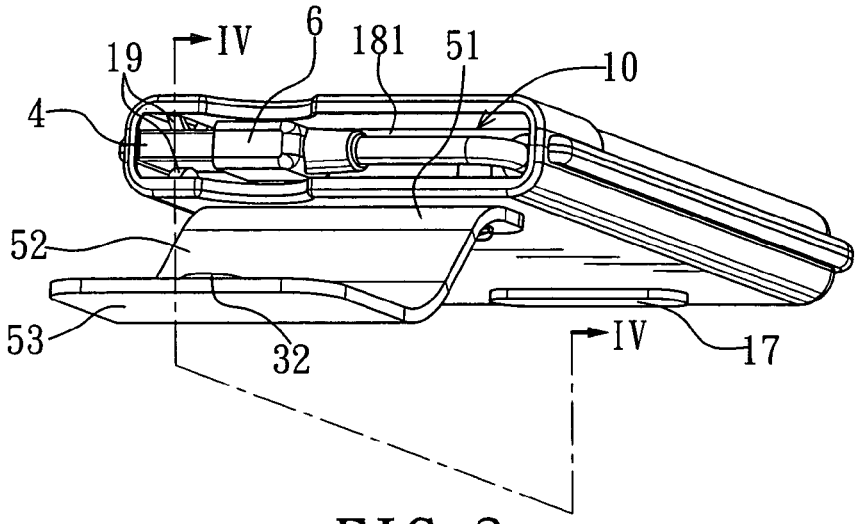
FIG. 3 is an assembled perspective view of the preferred embodiment when the external electrical connector is at a concealed position.

As shown in FIG. 3, the cover component 5 includes a fixing portion 51 that is secured to the first housing wall 11, a covering portion 52 that extends from the fixing portion 51, and an engaging portion 53 that extends from the covering portion 52. The cover component 5 is made from a flexible material, and is made from a leather fabric in this embodiment.

The releasable fastening unit 3 includes male and female fasteners 31, 32 provided respectively on the leather skin layer 15 of the housing 1 and the engaging portion 53 of the cover component 5. In this embodiment, the fastening unit 3 is a snap fastener, wherein the male fastener 31 is a ball snap component, and the female fastener 32 is a socket snap component.

The transmission cable 6 interconnects the interface module 2 and the external electrical connector 4, and has an end portion 62 terminated by the external electrical connector 4. The end portion 62 of the transmission cable 6 is movably disposed in the compartment 18 to permit movement of the external electrical connector 4 between a concealed position (shown in FIG. 3) and an exposed position (shown in FIG. 2) when the engaging portion 53 of the cover component 5 is released from the housing 1 such that the covering portion 52 uncovers the opening 10 in the housing 1. The external electrical connector 4 is at the concealed and exposed position when the same is disposed respectively inside and outside the compartment 18.

It should be noted herein that the transmission cable 6 is not a necessary component of the present invention. The interface module 2 and the external electrical connector 4 can be interconnected directly in other embodiments of the present invention.

Figure 2:
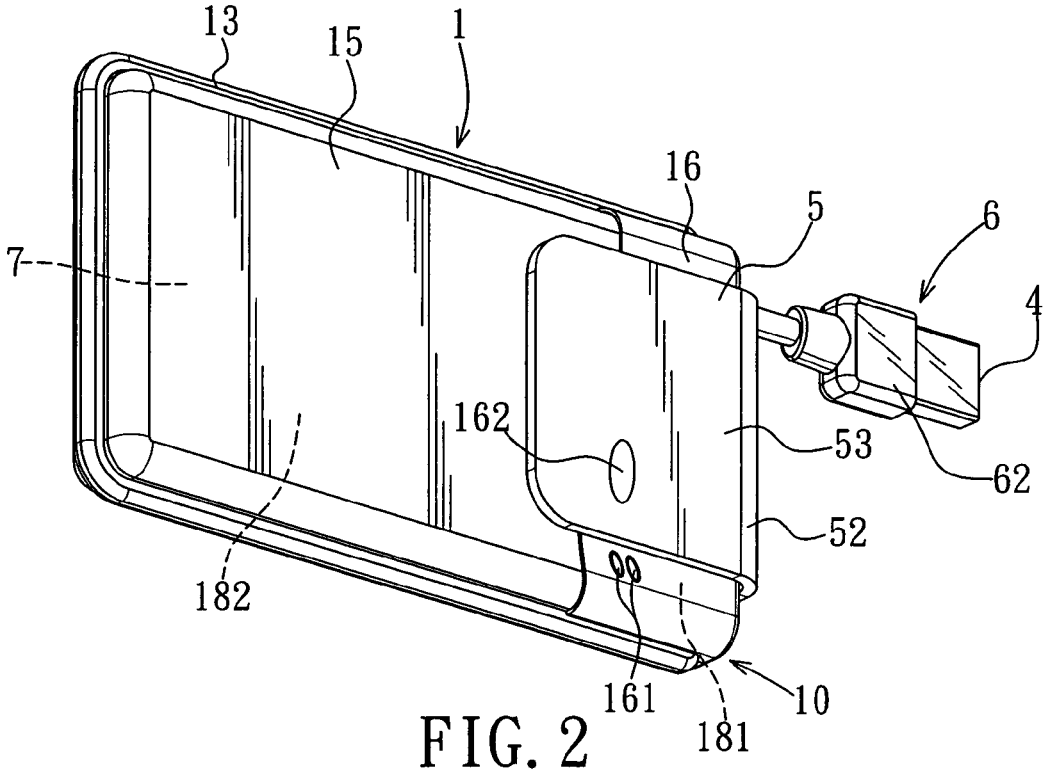
FIG. 2 is an assembled perspective view of the preferred embodiment when an external electrical connector is at an exposed position.

In this embodiment, the covering portion 52 spans a major part of the opening 10 in such a manner that the end portion 62 of the transmission cable 6 is prevented from blocking retention of the engaging portion 53 of the cover component 5 with the housing 1 when the external electrical connector 4 is at the exposed position, as best shown in FIG. 2.

In addition, the housing 1 is further provided with a partition 14 that separates the compartment 18 into first and second sub-compartments 181, 182 that are respectively proximate to and distal from the opening 10. The opening 10 is in spatial communication with the first sub-compartment 181. The second sub-compartment 182 has the interface module 2 disposed therein and is adapted to receive the data storage device 7 therein. The partition 14 is formed with a notch 141 to facilitate extension of the end portion 62 of the transmission cable 6 therethrough so as to be movably received in the first sub-compartment 181.

Figure 4:
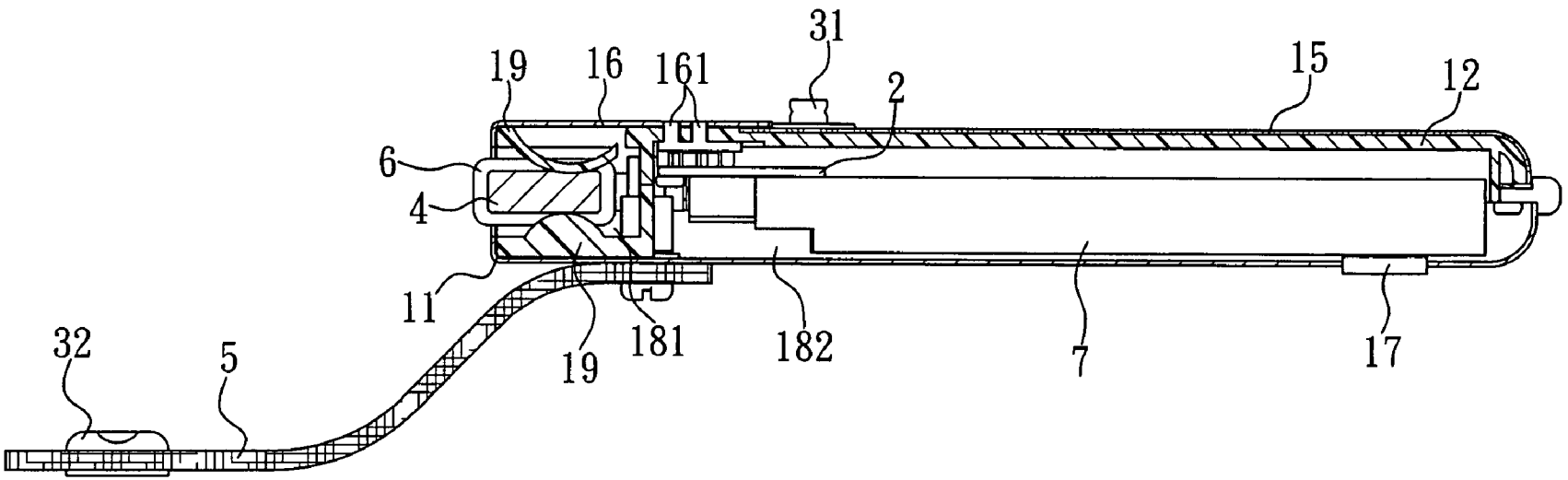
FIG. 4 is a sectional view of the preferred embodiment taken along line IV—IV in FIG. 3.

As shown in FIG. 4, the housing 1 is further provided with a retention unit 19 for retaining releasably the external electrical connector 4 at the concealed position. In this embodiment, the retention unit 19 includes a pair of resilient clamping strips, which are made from a plastic material, for clamping the external electrical connector 4.

For the following detailed description of the operation of the external casing according to this embodiment, the data storage device 7 is disposed in the external casing, and the data storage device 7, together with the external casing, cooperate to form a portable data storage device.

As shown in FIG. 3 and FIG. 4, in order to carry or store the portable data storage device, the external electrical connector 4 is at the concealed position, where the end portion 62 of the transmission cable 6 and the external electrical connector 4 are disposed in the first sub-compartment 181 in the housing 1. The external electrical connector 4 is secured in the first sub-compartment 181 by virtue of clamping action of the pair of resilient clamping strips of the retention unit 19. The male and female fasteners 31, 32 of the fastening unit 3 are then engaged together (not shown) such that the covering portion 52 of the cover component 5 covers the opening 10 in the housing 1. At this time, the portable data storage device is in a storing state. This ensures that the external electrical connector 4 is protected against dust in the environment, and damages due to scratches or bumping with other objects.

In order to place the portable data storage device in a using state, where the portable data storage device is adapted to connect to a computing device (not shown), the external electrical connector 4 needs to be disposed at the exposed position. To place the portable data storage device from the storing state to the using state, the male and female fasteners 31, 32 of the fastening unit 3 are disengaged from each other such that the engaging portion 53 of the cover component 5 is released from the housing 1, and such that the covering portion 52 of the cover component 5 uncovers the opening 10 in the housing 1, as best illustrated in FIG. 3. The external electrical connector 4 is then released from the retention unit 19, such that the external electrical connector 4 and the end portion 62 of the transmission cable 6 can move out of the first sub-compartment 181 of the housing 1. Since the covering portion 52 of the cover component 5 spans only a major part of, and not all of, the opening 10, the male and female fasteners 31, 32 can still engage each other when the end portion 62 of the transmission cable 6 is moved out of the first sub-compartment 181, such that the engaging portion 53 of the cover component 5 is retained on the housing 1, as shown in FIG. 2.

Therefore, the present invention utilizes the releasable fastening unit 3 provided on the cover component 5 and the housing 1 to retain releasably the engaging portion 53 of the cover component 5 on the housing 1 such that the external electrical connector 4 can move between the concealed position and the exposed position, thereby ensuring that the external electrical connector 4 is protected from damage when the same is not in use.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. An external casing for a data storage device, said external casing comprising:

a housing that confines a compartment adapted for receiving the data storage device therein and that is formed with an opening for access into said compartment, said housing having opposite first and second housing walls;

an interface module that is disposed in said compartment and that is adapted to connect electrically with the data storage device disposed in said compartment;

an external electrical connector that is connected electrically to said interface module and that is disposed in said compartment in the vicinity of said opening;

a cover component including a fixing portion that is secured to said first housing wall, a covering portion that extends from said fixing portion, and an engaging portion that extends from said covering portion; and a releasable fastening unit provided on said engaging portion of said cover component and said second housing wall to retain releasably said engaging portion on said housing such that said covering portion covers said opening in said housing.

2. The external casing as claimed in claim 1, wherein said cover component is made from a flexible material.

3. The external casing as claimed in claim 1, wherein said cover component is made from a leather fabric.

4. The external casing as claimed in claim 1, wherein said housing includes a looped metal frame that interconnects said first and second housing walls.

5. The external casing as claimed in claim 1, wherein said releasable fastening unit includes male and female fasteners provided on said engaging portion of said cover component and said second housing wall of said housing, respectively.

6. The external casing as claimed in claim 1, wherein said first housing wall is made from a metal material.

7. The external casing as claimed in claim 1, further comprising an anti-slip pad provided on said first housing wall.

8. The external casing as claimed in claim 1, wherein said second housing wall is made from a plastic material.

9. The external casing as claimed in claim 1, wherein said external electrical connector is a Universal Serial Bus (USB) connector.

10. The external casing as claimed in claim 1, further comprising a transmission cable interconnecting said interface module and said external electrical connector.

11. The external casing as claimed in claim 10, wherein said transmission cable has an end portion terminated by said external electrical connector, said end portion of said transmission cable being movably disposed in said compartment to permit movement of said external electrical connector between a concealed position, where said external electrical connector is disposed inside said compartment, and an exposed position, where said external electrical connector is disposed outside said compartment, when said engaging portion of said cover component is released from said housing such that said covering portion uncovers said opening in said housing.

12. The external casing as claimed in claim 11, wherein said covering portion spans a major part of said opening in such a manner that said end portion of said transmission cable is prevented from blocking retention of said engaging portion of said cover component with said housing when said external electrical connector is at the exposed position.

13. The external casing as claimed in claim 11, wherein said housing is provided with a partition that separates said compartment into first and second sub-compartments that are respectively proximate to and distal from said opening, said second sub-compartment having said interface module disposed therein and being adapted to receive the data storage device therein, said end portion of said transmission cable extending through said partition and being movably received in said first sub-compartment.

14. The external casing as claimed in claim 11, wherein said housing is provided with a retention unit for retaining releasably said external electrical connector at the concealed position.

15. The external casing as claimed in claim 14, wherein said retention unit includes a pair of resilient clamping strips for clamping said external electrical connector.

16. The external casing as claimed in claim 1, wherein said housing further includes a leather skin layer disposed on said second housing wall.

17. The external casing as claimed in claim 16, wherein said releasable fastening unit includes male and female fasteners provided on said engaging portion of said cover component and said leather skin layer of said housing, respectively.

18. The external casing as claimed in claim 16, wherein said housing further includes a cover plate superimposed on a portion of said leather skin layer and provided with a user-operable button that extends through said leather skin layer and said second housing wall into said compartment, said interface module including a switch that is coupled to and actuated through said user-operable button for data access control.

19. The external casing as claimed in claim 18, wherein said interface module further includes at least a status indicator for providing visual indication of data access state of the data storage device that is visible through said second housing wall and said leather skin layer, and said cover plate is provided with a light guide for said status indicator.

20. The external casing as claimed in claim 18, wherein said cover plate is made from a metal material.

* * * * *